US006966407B2

(12) United States Patent
Karnes et al.

(10) Patent No.: US 6,966,407 B2
(45) Date of Patent: Nov. 22, 2005

(54) ESCAPE-RIGHT

(76) Inventors: Loren Eugene Karnes, 630 S. 4th St., LeSeur, MN (US) 56058; Paul Alan Van Brunt, 196 Erin Ave., Prior Lake, MN (US) 55372

( * ) Notice: Subject to any disclaimer, the term of this patent is extended or adjusted under 35 U.S.C. 154(b) by 0 days.

(21) Appl. No.: 10/664,183

(22) Filed: Sep. 17, 2003

(65) Prior Publication Data

US 2004/0055824 A1 Mar. 25, 2004

Related U.S. Application Data

(60) Provisional application No. 60/411,636, filed on Sep. 18, 2002.

(51) Int. Cl.[7] ..... A62B 1/10; A62B 1/08; B66D 1/48; B65H 59/16

(52) U.S. Cl. ..... 182/239; 182/236; 254/267; 188/65.3

(58) Field of Search ..... 182/239, 236, 182/73, 70, 238, 192, 193, 231, 237; 188/65.1–65.4; 254/267, 264, 405, 389–391

(56) References Cited

U.S. PATENT DOCUMENTS

| | | | | |
|---|---|---|---|---|
| 286,306 | A | | 10/1883 | Johnson |
| 492,180 | A | | 2/1893 | Athey |
| 567,553 | A | | 9/1896 | Riley |
| 715,691 | A | | 12/1902 | Porter |
| 779,284 | A | | 1/1905 | Johnson |
| 1,037,338 | A | | 9/1912 | Scheuer |
| 1,419,532 | A | | 6/1922 | Abott |
| 2,680,593 | A | | 6/1954 | McIntyre |
| 2,761,650 | A | | 9/1956 | Faugier |
| 2,990,131 | A | | 6/1961 | Carlsson |
| 3,041,044 | A | | 6/1962 | Nixon |
| 4,416,430 | A | | 11/1983 | Totten |
| 4,432,437 | A | | 2/1984 | McClung |
| 4,448,284 | A | | 5/1984 | Ciabo |
| 4,457,400 | A | | 7/1984 | Donaldson |
| 4,588,046 | A | | 5/1986 | van der Neer |
| 4,602,699 | A | | 7/1986 | Matt |
| 4,611,688 | A | * | 9/1986 | Sekhar ..... 182/237 |
| 4,623,038 | A | | 11/1986 | Stancato |
| 4,640,388 | A | * | 2/1987 | Walborn ..... 182/231 |
| 4,653,609 | A | * | 3/1987 | Devine ..... 182/238 |
| 4,712,645 | A | | 12/1987 | Shih |
| 4,938,435 | A | | 7/1990 | Varner |
| 4,941,548 | A | | 7/1990 | Blanchard |
| 4,941,549 | A | * | 7/1990 | Da-Tan et al. ..... 182/234 |
| 4,986,390 | A | | 1/1991 | Kikuchi |
| 5,343,981 | A | * | 9/1994 | Schroemges et al. ..... 182/231 |
| 5,730,407 | A | | 3/1998 | Ostrobrod |

* cited by examiner

*Primary Examiner*—Hugh B. Thompson, II
(74) *Attorney, Agent, or Firm*—Roger Belfay

(57) ABSTRACT

The Escape-Right is an emergency escape system comprising: a passenger harness, a cable, a reel, a shaft fixed to the reel permitting rotation of the reel as the cable is unrolled, a reduction gear assembly, a centrifugal brake assembly, a housing enclosing the brake assembly, and a mounting mechanism. The escape right is a mechanism to escape or descend from the upper floors of a building when the usual exits are unavailable. The Escape-Right may be anchored to prepared points, heavy objects within the building, or a ladder placed near the exit portal. The braking mechanism may be attached to the anchor point or the user. In some configurations of the Escape-Right multiple descents may be accomplished without rewinding the cable.

11 Claims, 10 Drawing Sheets

ESCAPE-RIGHT

CROSS REFERENCE TO RELATED APPLICATIONS

The application listed below is the only application related to this application. This application claims benefit of the earlier filing date under 35 USC 119(e) of provisional application No. 60/411,636 filed on Sep. 18, 2002.

The Escape-Right is a lowering system intented for use as a fire but which may be employed for other applications where a controlled lowering of people or materials is required. The device includes a harness, cable, and braking system to control the rate at which be cable is payed out. The Escape-Right is embodied in several different configurations to facilitate egress from buildings or high places where emergency egress may be required. Four exemplary configurations are: 1) a permanently mounted version in which the device is permanently mounted within a building or other structure, 2) a temporarily mounted version in which the device detachably attaches to a prepared mounting point, 3) a rescue version in which the device is detachably attached to a ladder or other temporaly structure provided to assist in egress, and 4) a back-pack version wherein in the braking mechanism is attached to the user's harness while the end of the cable is attached to a support point.

STATEMENT REGARDING FED SPONSORED RESEARCH OR DEVELOPMENT

No invention claimed in this application was made under Federally sponsored research or development.

BACKGROUND OF THE INVENTION

The present invention is directed toward a fire escape system. There are a number of lowering systems, which provide for user-controlled rate of descent for lowering people and objects from high places. The Escape-Right provides a safe rate of descent in which the user does not control the rate of descent. This provides an advantage to an incapacitated user who may not be able to operate the controls necessary to make a safe descent.

There are a number of fire escape and lowering systems, which employ ropes and tapes to support the user in transit. The Escape-Right employs a stainless steel cable to implement a fireproof chain of support from the chosen support point of the Escape-Right to the user. This imparts a significant advantage in circumstances where a fire would be rapidly developing or where fire envelopes the Escape-Right or its cable after the user has passed the fire zone but has not yet reached a safe height.

A number of fire escape and lowering systems include a braking system. The Escape-Right employs a completely enclosed centrifugal brake mechanism. The presence of liquids does not degrade this centrifugal brake mechanism due to its enclosed nature. The enclosed centrifugal brake system is significantly less susceptible to fire damage due to its enclosed nature.

BRIEF SUMMARY OF THE INVENTION

The Escape-Right is a fire escape system for use where egress from upper floors, or any other high place, is necessary but the customary or even emergency escape routes are not available. The Escape-Right provides a cable and harness, which supports a user during a descent from such a place and controls the user's rate of descent so as to prevent injury. Fire often results in such situations. The Escape-Right is constructed of fireproof materials to assure maximum flexibility of use in such a fire related emergency. In some configurations, the Escape-Right permits multiple descents without stopping to rewind the cable. The backpack version of the Escape-Right permits individuals to provide their own portable escape system. The Escape-Right system may be permanently, or temporarily mounted to a prepared support point within a building or other high place or it may be temporarily mounted to a ladder or other rescue system.

DETAILED DESCRIPTION OF THE INVENTION

Figure 1:
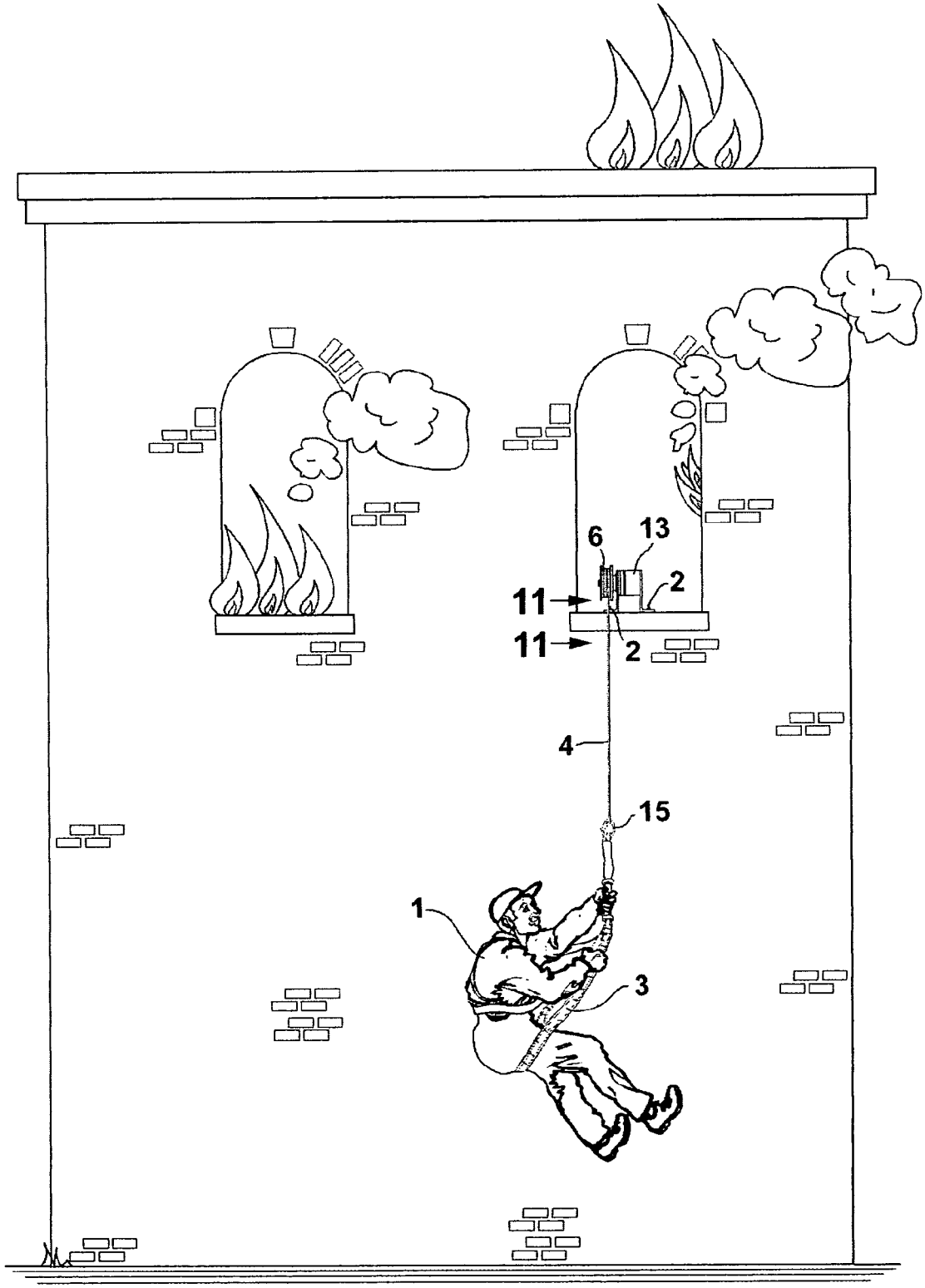
FIG. 1 depicts a user descending from a burning building using the Escape-Right fixed to a prepared point within the building.
Figure 2:
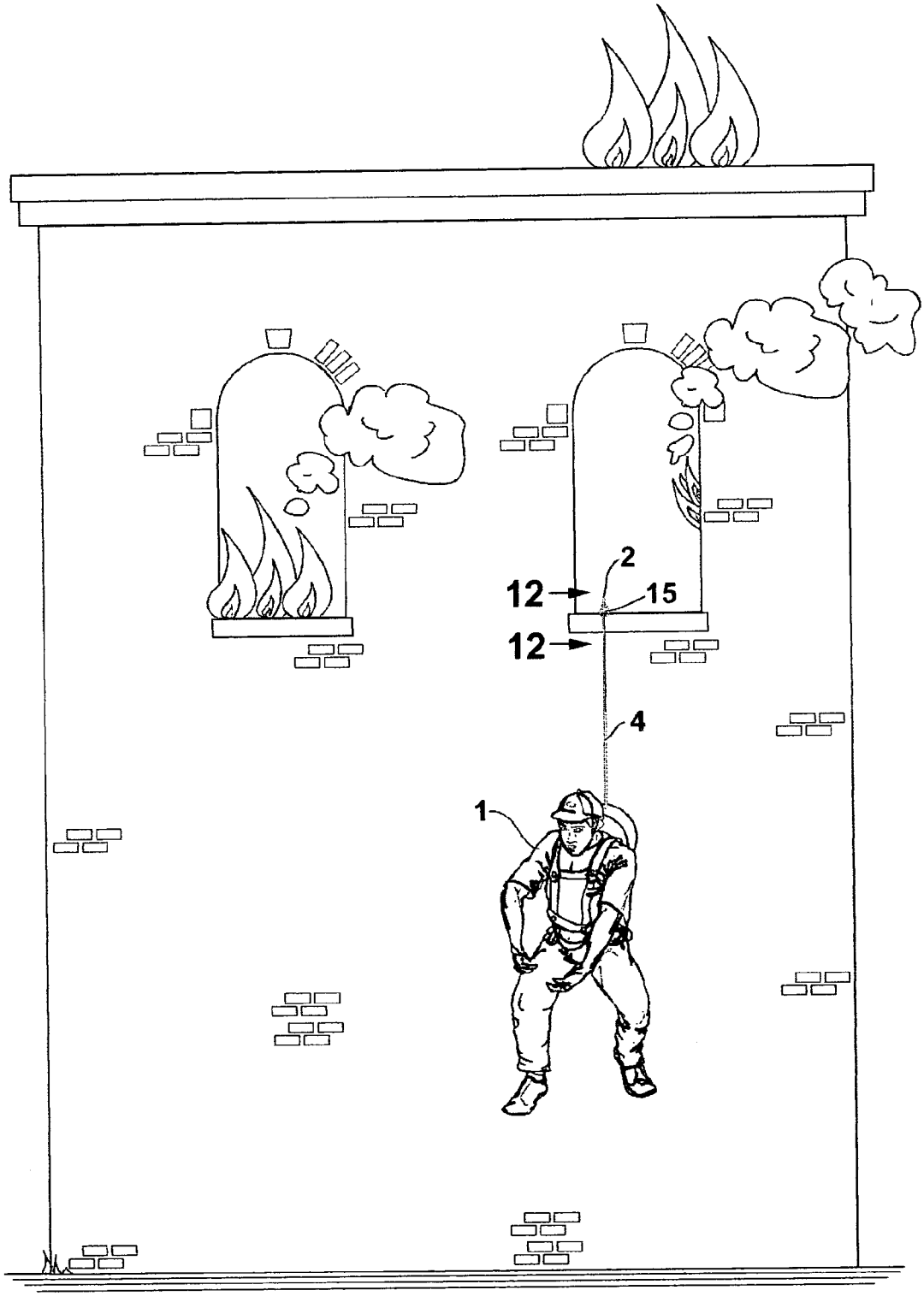
FIG. 2 depicts a user descending from a burning building using the back-pack configuration of the Escape-Right.
Figure 3:
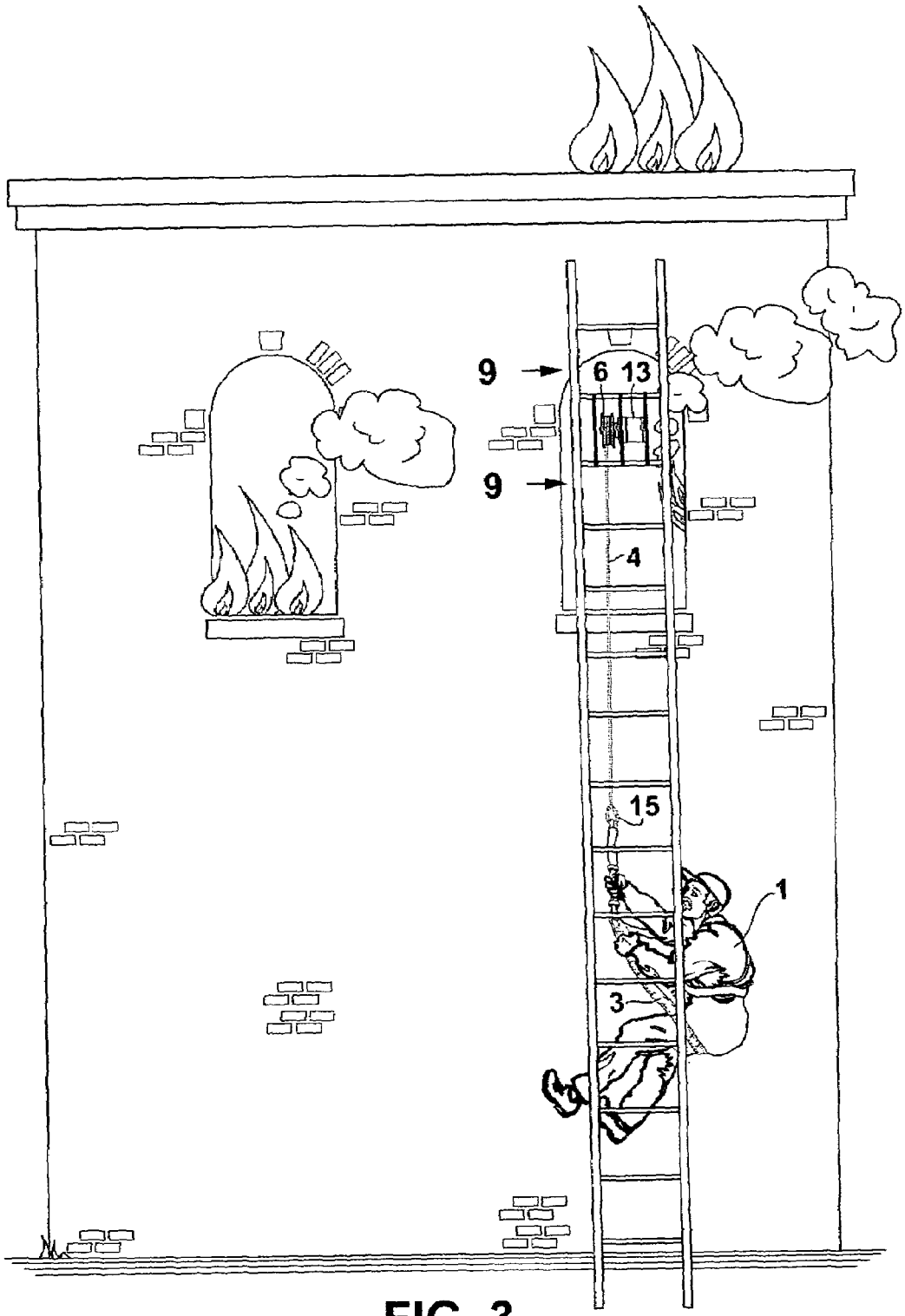
FIG. 3 depicts a user descending from a burning building using the Escape-Right fixed to a supporting ladder external to the building.
Figure 4:
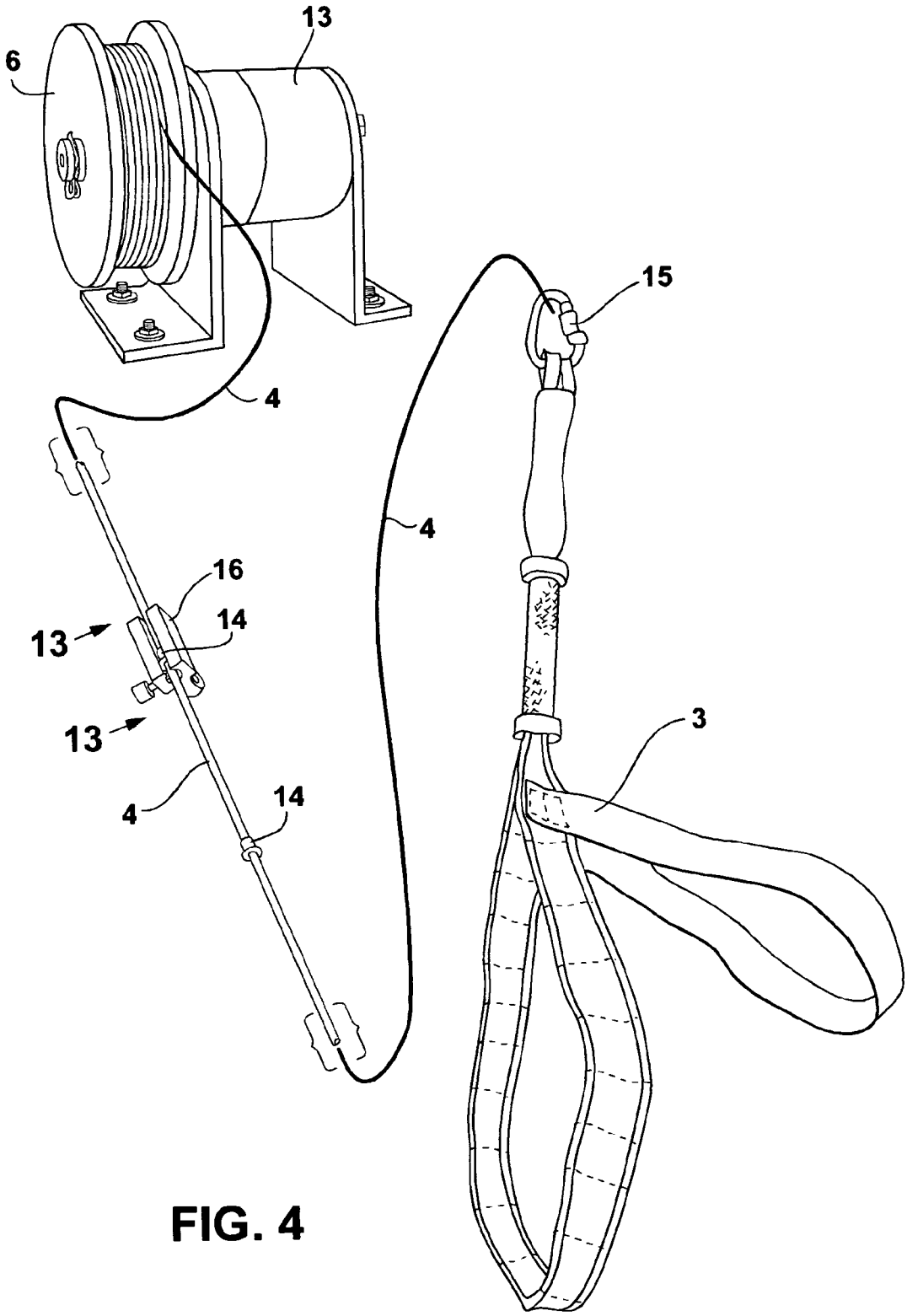
FIG. 4 depicts the Escape-Right with a tie point for a second descender.
Figure 5:
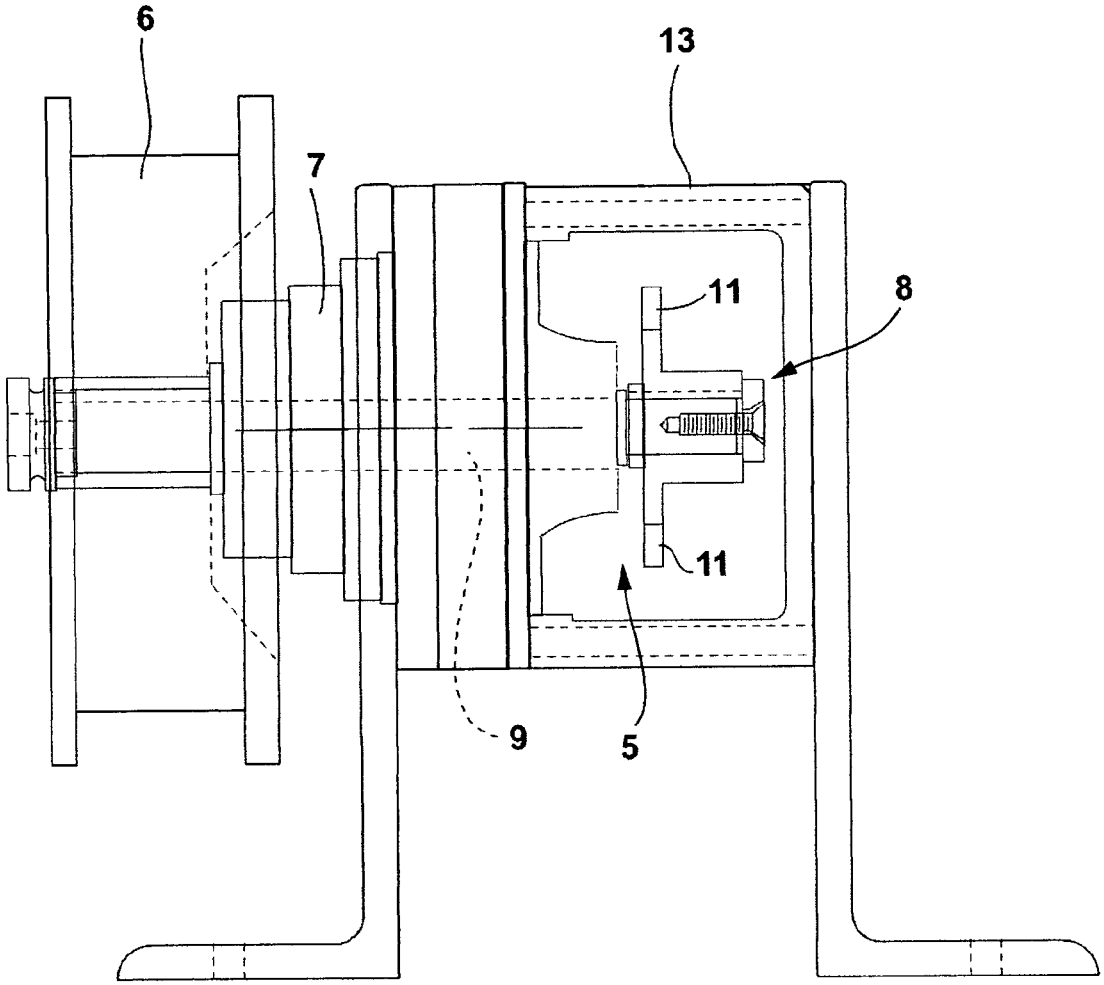
FIG. 5 is a partial sectional view of the Escape-Right depicting the reel, reduction gear, and centrifugal brake assembly.
Figure 6:
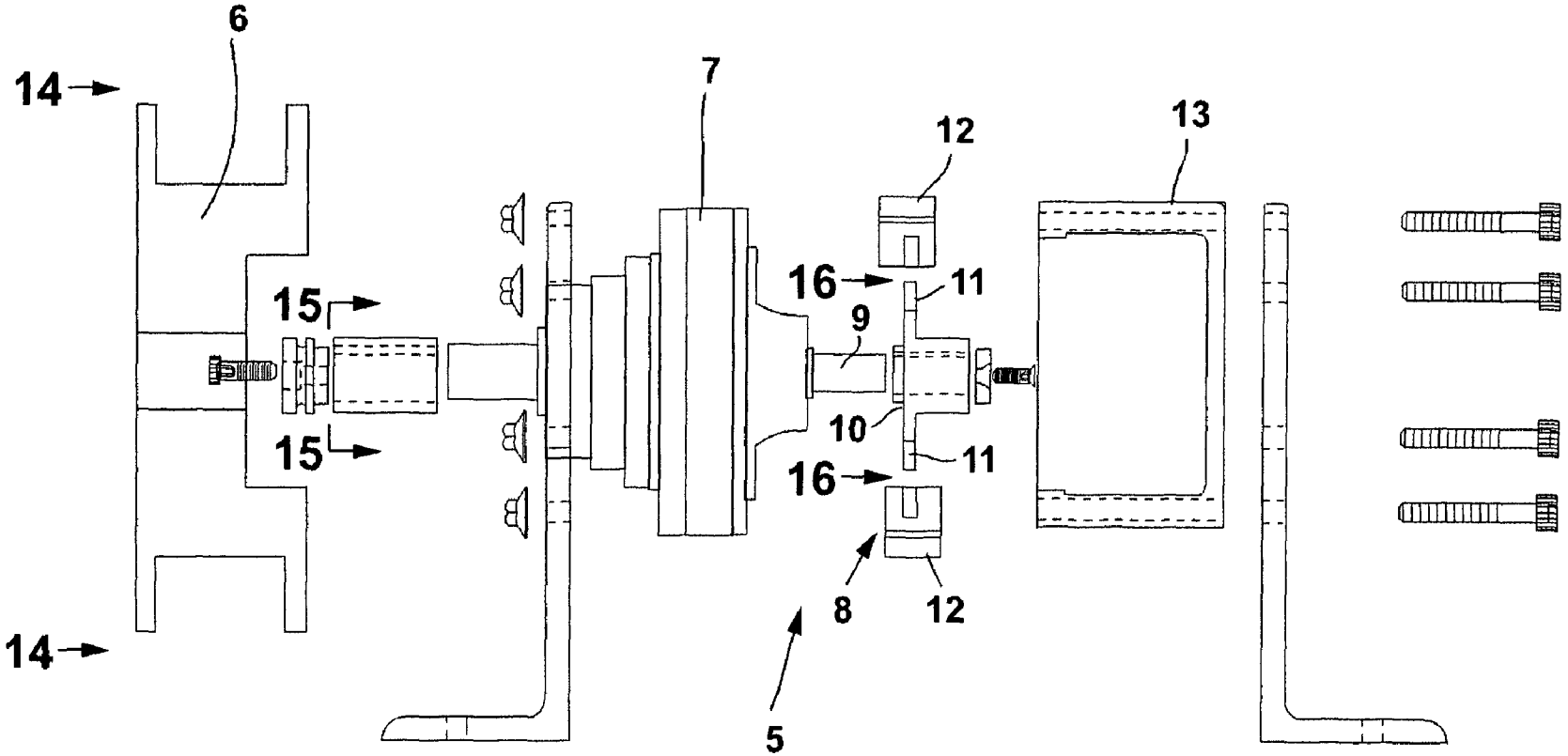
FIG. 6 is an exploded view of the reel, reduction gear, and centrifugal brake assembly.
Figure 8:
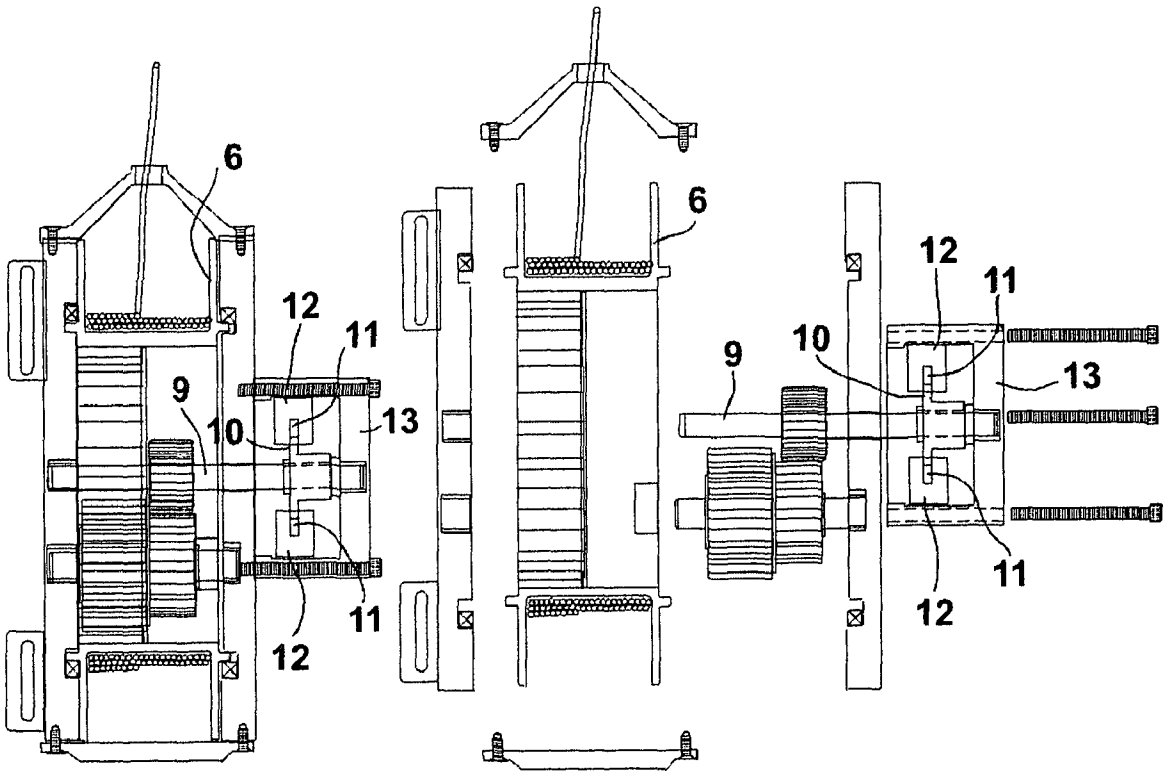
FIG. 8 is an exploded view of the reel, reduction gear, and brake assembly for the backpack unit.
Figure 7:
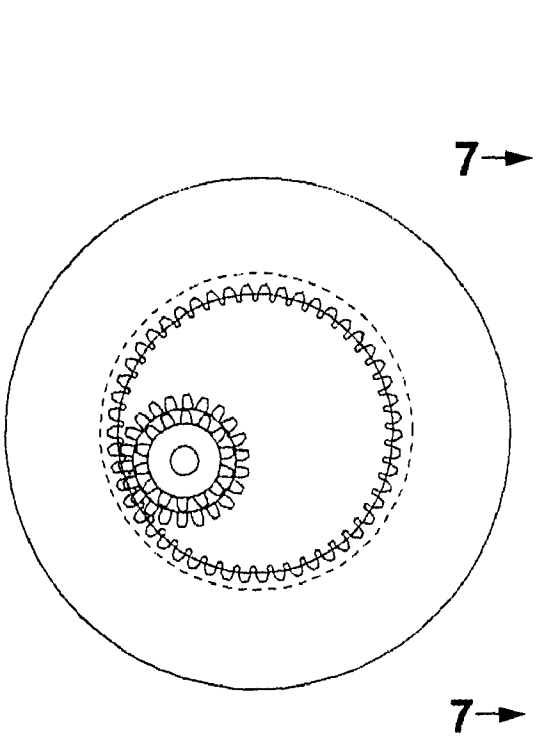
FIG. 7 is a cross section view of the reduction gear assembly for the backpack unit.
Figure 9:
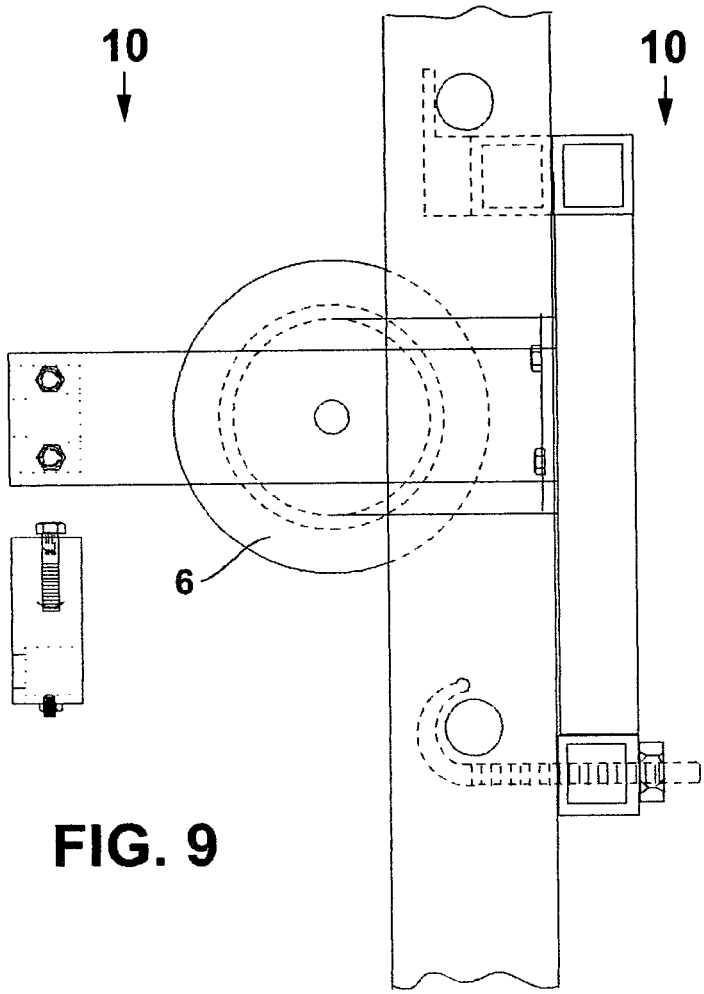
FIG. 9 is a side elevation view of the Escape-Right of the ladder mount configuration.
Figure 10:
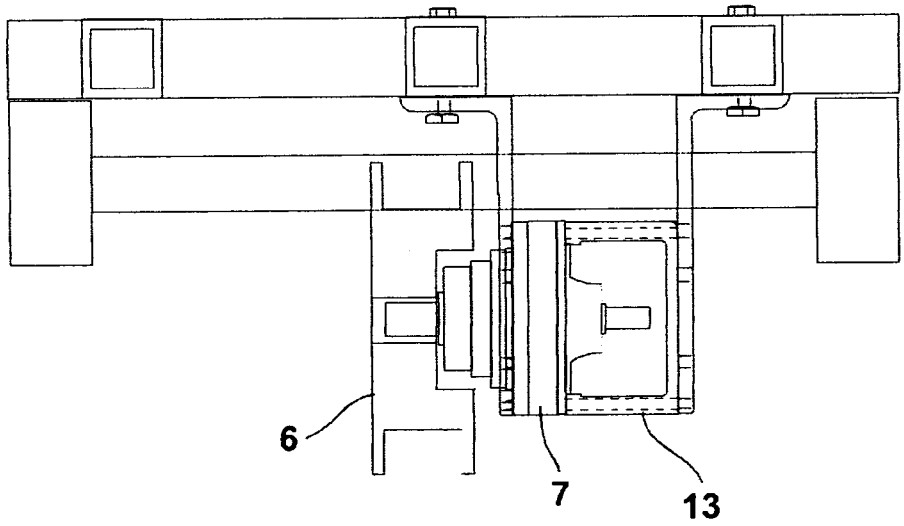
FIG. 10 is a top view of the Escape-Right ladder mount configuration.
Figure 11:
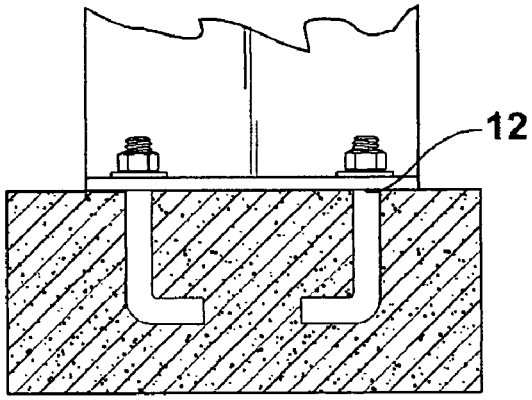
FIG. 11 is a section view of the Escape-Right mounting bracket mounted to a surface.
Figure 12:
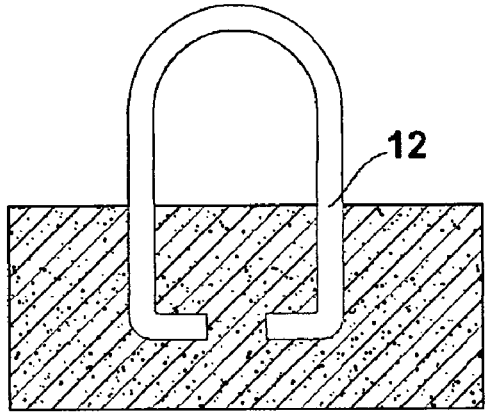
FIG. 12 is a section view of a prepared mounting point for the Escape-Right.
Figure 13:
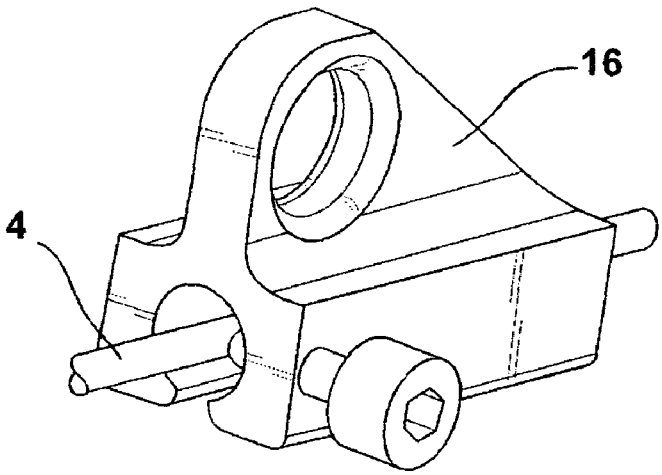
FIG. 13 depicts the attachment mechanism for a subsequent descender's harness.
Figure 14:
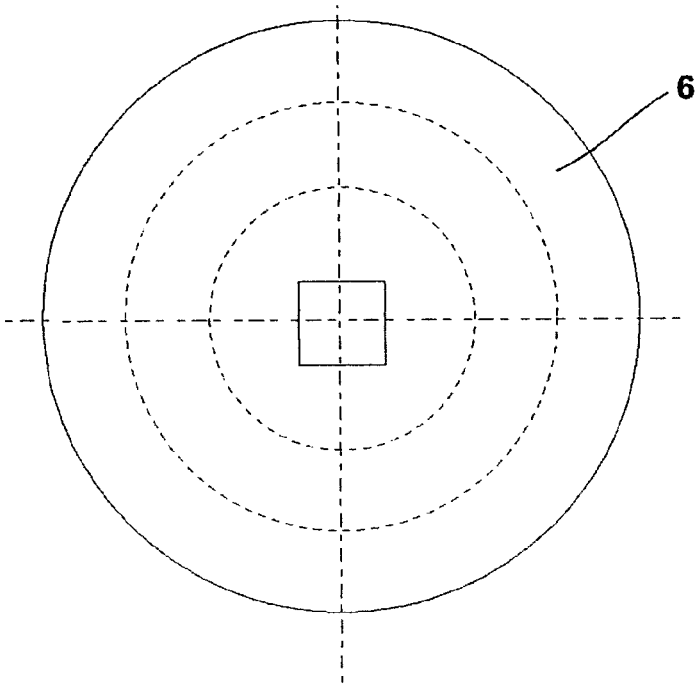
FIG. 14 depicts the reel with a square center shaft.
Figure 15:
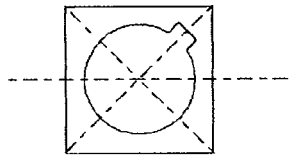
FIG. 15 depicts a square shaft with a circular keyed shaft embedded.
Figure 17:
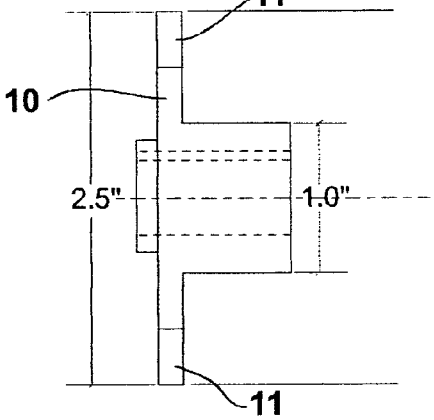
FIG. 17 is a front view of the circular plate of the centrifugal brake with two tabs.
Figure 16:
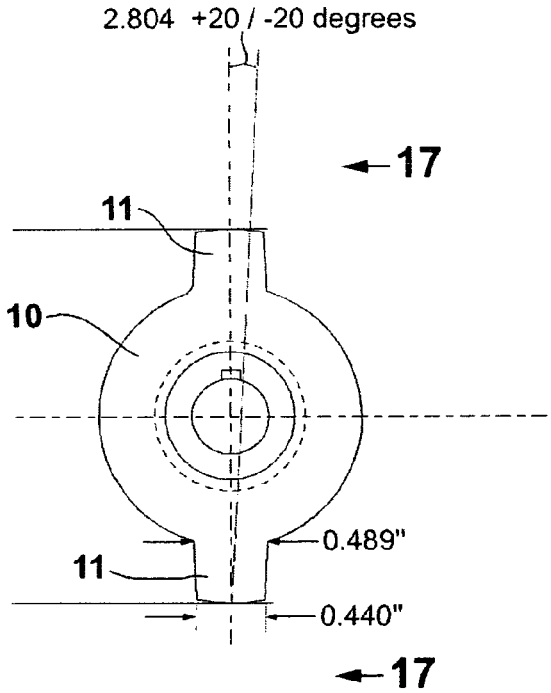
FIG. 16 is an edge view of the circular plate of the centrifugal brake.

The Escape-Right is a device and system, which permits egress from the upper floors of buildings or other high locations where the normally available routes of egress are unavailable due to fire or other life threatening conditions, and the height of the exit portal prohibits safe egress by walking, jumping, climbing or other unaided means. The Escape-Right lowers the user 1 at a safe and controlled speed. The Escape-Right is anchored at a support point 2. The user 1 is attached to the Escape-Right via a harness 3 which in turn in attached to either the cable 4 or the housing 13 of the Escape-Right's braking mechanism 5. The braking mechanism 5 is comprised of a reel 6 on which the cable 4 is coiled, a reduction gear 7 which multiplies the rotational speed of the reel 6, and a centrifugal brake 8. As the weight of the user 1 tensions the cable 4 the reel 6 pays out the cable 4 by rotating. A shaft 9 transmits the rotation of the reel 6 to the reduction gear 7 to increase the speed of rotation. The reduction gear 7 transmits the increased rotary motion to the centrifugal brake 8.

The increased rotary motion causes the circular plate 10 to rotate at a rate sufficient for the tabs 11 to force the brake shoes 12 against the outside of the housing 13 and through friction between the housing 13 and brake shoes 12 resist the rotary motion imparted by the reel 6 through the reduction gear 7. This resistance reduces the speed of the user 1 descent to a safe rate of speed. The reduction gear 7 gear ratio is selected to provide a safe rate of descent for the maximum anticipated weight for a user 1. In many applications a gear ratio of approximately 13:1 has worked satisfactorily.

The cable 4 is selected from fire-proof materials such as stainless steel to prevent failure due to exposure to fire either during or prior to use by the user 1 and is of such a size that the maximum anticipated weight for a user 1 can be supported with a substantial safety margin.

In some configurations the cable 4 will include flexible attachment points 14 at distances corresponding to the anticipated height from which descents will be made. These flexible attachment points are points at which a second or subsequent user 1 may attach a harness 3 using the connector 16 and descend without recoiling the cable 4 on the reel 6.

In yet other configurations the Escape-right will provide descent for a number of users by providing each user with a reel 6, cable 4, and harness 3. In this configuration each user will detach the previous users reel 6, cable 4 and harness 3 from the centrifugal brake 8 and reduction gear 7 and replace it with his own reel 6, cable 4, and harness 3 using the quick-disconnect means 15 provided.

We claim:

1. An emergency escape system comprising:

(a) a passenger harness, (b) a cable detachably attached to the harness, (c) a reel connected to the cable for storage of the cable, (d) a shaft attached to the reel permitting rotation of the reel as the cable is unrolled from the reel, (e) a reduction gear assembly fixed to the shaft to multiply the reel rotation rate, (f) a centrifugal brake assembly attached to the reduction gear assembly, said centrifugal brake assembly comprising:

(1) a circular casing, (2) a circular central plate with a plurality of tabs, (3) a plurality of brake shoes fitted over the plurality of tabs, and (4) a shaft connecting the central disk and piercing the casing at the center of the circular cross section of the casing to connect to a external source of rotary motion, (g) a housing enclosing the brake assembly, (h) a mounting means fixing the housing to a point of support.

2. The emergency escape system of claim 1 wherein the mounting means is configured to attach to a prepared mounting point within a building or dwelling structure.

3. The emergency escape system of claim 1 wherein the mounting means is configured to attach to the top of a ladder positioned near an egress port of a building or dwelling structure.

4. The emergency escape system of claim 1 wherein the cable includes flexible attachment points spaced to accommodate multiple descents without rewinding the cable on the reel.

5. The emergency escape system of claim 1 wherein the shaft is detachably attached to the reel.

6. The emergency escape system of claim 1 wherein the plurality of tabs and break shoes consists of two tabs and two brake shoes.

7. The emergency escape system of claim 1 wherein the plurality of tabs and break shoes consists of two tabs and two brake shoes.

8. An emergency escape system comprising:

(a) a passenger harness, (b) a cable connecting to a mounting means, (c) a reel connected to the cable for storage of the cable, (d) a shaft fixed to the reel permitting rotation of the reel as the cable is unrolled from the reel, (e) a reduction gear assembly fixed to the shaft to multiply the reel rotation rate, (f) a centrifugal brake assembly attached to the reduction gear assembly, said centrifugal brake assembly comprising:

(1) a circular casing, (2) a circular central plate with a plurality of tabs, (3) a plurality of brake shoes fitted over the plurality of tabs, and (4) a shaft connecting the central disk and piercing the casing at the center of the circular cross section of the casing to connect to a external source of rotary motion, (g) a housing enclosing the brake assembly, (h) the housing fixed to the passenger harness.

9. The emergency escape system of claim 8 wherein the plurality of tabs and brake shoes consists of two tabs and two brake shoes.

10. The emergency escape system of claim 8 wherein the mounting means is configured to attach to a prepared mounting point within a building or dwelling structure.

11. The emergency escape system of claim 8 wherein the mounting means is configured to attach to the top of a ladder positioned near an egress port of a building or dwelling structure.

* * * * *